US008790195B1

(12) United States Patent
Myers et al.

(10) Patent No.: US 8,790,195 B1
(45) Date of Patent: Jul. 29, 2014

(54) GOLF CLUB HEAD WITH ADJUSTABLE CHARACTERISTICS

(71) Applicant: Callaway Golf Company, Carlsbad, CA (US)

(72) Inventors: Matthew Myers, Carlsbad, CA (US); Wayne H. Byrne, Murietta, CA (US); Larry Tang, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 16 days.

(21) Appl. No.: 13/766,658

(22) Filed: Feb. 13, 2013

Related U.S. Application Data

(60) Provisional application No. 61/746,348, filed on Dec. 27, 2012.

(51) Int. Cl.
*A63B 53/06* (2006.01)
*A63B 53/04* (2006.01)

(52) U.S. Cl.
CPC ..... *A63B 53/06* (2013.01); *A63B 53/0466* (2013.01)
USPC ..... 473/338; 473/335; 473/345; 473/349

(58) Field of Classification Search
USPC ..... 473/338, 335, 336, 345, 349
See application file for complete search history.

(56) References Cited

U.S. PATENT DOCUMENTS

| | | | | |
|---|---|---|---|---|
| 8,377,319 | B2 * | 2/2013 | Chen et al. | 216/27 |
| 2010/0331103 | A1 * | 12/2010 | Takahashi et al. | 473/338 |
| 2012/0122601 | A1 * | 5/2012 | Beach et al. | 473/248 |

* cited by examiner

*Primary Examiner* — Benjamin Layno
(74) *Attorney, Agent, or Firm* — Rebecca Hanovice; Michael A. Catania; Sonia Lari

(57) ABSTRACT

A golf club head with means for adjusting a center of gravity along more than one axis and means adjusting at least one of a characteristic selected from the group consisting of face angle, loft angle, and lie angle is disclosed herein. The golf club head may comprise one or more adjustable features such as weight bars, weight screws, weight cartridges, and adjustable sole members.

18 Claims, 4 Drawing Sheets

GOLF CLUB HEAD WITH ADJUSTABLE CHARACTERISTICS

The present application claims priority to U.S. Provisional Patent No. 61/746,348, filed on Dec. 27, 2012, the disclosure of which is hereby incorporated by reference in its entirety herein.

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a golf club head. More specifically, the present invention relates to a golf club head having a plurality of adjustable features that allow the club head's center of gravity to be moved along multiple axes.

2. Description of the Related Art

The ability to adjust center of gravity location and weight in the head of golf clubs is useful for controlling performance of the golf club, particularly in wood-type golf clubs such as drivers. The prior art includes several different solutions for adjustable weighting, but these solutions do not optimize weight adjustment because they typically allow for center of gravity (CG) adjustment along only one axis. See, for example, U.S. Pat. Nos. 7,611,424 and 8,016,694. Therefore, there is a need for a weighting mechanism that allows for simple and flexible center of gravity and moment of inertia (MOI) adjustability along more than one axis.

BRIEF SUMMARY OF THE INVENTION

The present invention is a novel way of working with adjustable products. The present invention allows consumers to adjust the center of gravity of a golf club head along both vertical and horizontal axes. The objective of this invention is to provide a plurality of adjustable weights with minimal or no effect on appearance at address while maximizing the ability of the weight to adjust center of gravity height. Additional goals include adjusting a loft, lie, and/or face angle of the golf club head.

Yet another aspect of the present invention is a golf club head comprising a body comprising a face, a sole, and a hosel, means for adjusting a center of gravity along a horizontal axis, means for adjusting the center of gravity along a vertical axis, and means for adjusting at least one of a characteristic selected from the group consisting of face angle, loft angle, and lie angle.

Another aspect of the present invention is a golf club head comprising a face, a crown, a sole, and a hosel, at least one weight bar, at least one removable weight member, and a central axis, wherein the sole comprises a recessed region and a weight port sized to receive the at least one removable weight member, wherein the weight port is located at a midpoint of the recessed region, wherein the central axis intersects a midpoint of the weight port, wherein the at least one weight bar comprises a first end and a second end, wherein the first end has an opening sized to receive the at least one removable weight member, wherein the second end is slidable along the recessed region around the central axis, and wherein the at least one removable weight member removably affixes the first end of the weight bar to the sole such that the at least one weight bar cannot be moved when the removable weight bar is tightly secured within the weight port. In some further embodiments, the at least one removable weight member may be a weight screw. In other embodiments, the golf club head may further comprise an adjustable hosel assembly.

In other embodiments, the at least one removable weight member may be a weight cartridge. In these embodiments, the weight cartridge may be composed of more than one material, and may have a first region composed of a first material and a second region composed of a second material, wherein the first material may have a greater density than the second material. In some embodiments, the weight member may have a cylindrical shape, though in others it may have a polygonal shape.

In other embodiments, the golf club head may comprise an adjustable sole member, wherein the adjustable sole member may have a plurality of settings that affect at least one of golf club face angle, loft, and lie. In some of these embodiments, the adjustable sole member may comprise a through bore sized to receive the at least one removable weight member, and the adjustable weight member may be disposed between the at least one removable weight member and the at least one weight bar. In some of these embodiments, the adjustable sole member may comprises a first setting having a first height, a second setting having a second height, and a third setting having a third height, wherein the first height may be greater than the second height and the second height may be greater than the third height. In some embodiments, the adjustable sole member may be circular, while in others, it may have a polygonal shape such as triangular or square.

In some embodiments of the present invention, the at least one weight bar may comprise first and second weight bars. In other embodiments, the at least one weight bar may have an approximately rectangular shape, and may have at least one opening disposed proximate its second end. In still other embodiments, the at least one weight bar may be composed of more than one material. For example, the first end of the weight bar may be composed of a first material having a first density, the second end of the weight bar may be composed of a second material having a second density, and the second density may be greater than the first density.

Yet another aspect of the present invention is a driver-type golf club head comprising a face, a crown, a sole, a hosel, a toe end, and a heel end, a weight screw, an adjustable sole member comprising a plurality of settings and a first through bore sized to receive the weight screw, a first weight bar comprising a first end, a second end, and a second through bore sized to receive the weight screw, and a second weight bar comprising a third end, a fourth end, and a third through bore sized to receive the weight screw, wherein the sole comprises a recessed region, wherein the recessed region comprises a guide rail and a weight port sized to receive the weight screw, wherein the weight port is disposed in a central region of the sole, wherein an axis intersects the weight port and extends upwards towards the crown, wherein the weight screw is sized to extend through the first, second and third through bores to affix the adjustable sole member, the first weight bar, and the second weight bar to the sole within the recessed region, and wherein each of the adjustable sole member, the first weight bar, and the second weight bar are rotatable around the axis. In some embodiments, the second through bore may extend through the second end, the third through bore may extend through the fourth end, and each of the first and third ends may make contact with and be configured to slide along the guide rail. In another embodiment, each of the settings of the adjustable sole member may affect at least one characteristic selected from the group consisting of face angle, loft angle, and lie angle. In still another embodiment, each of the face and the hosel may be composed of a metal material, and each of the crown and the sole may be composed of a non-metal material such as a composite material.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
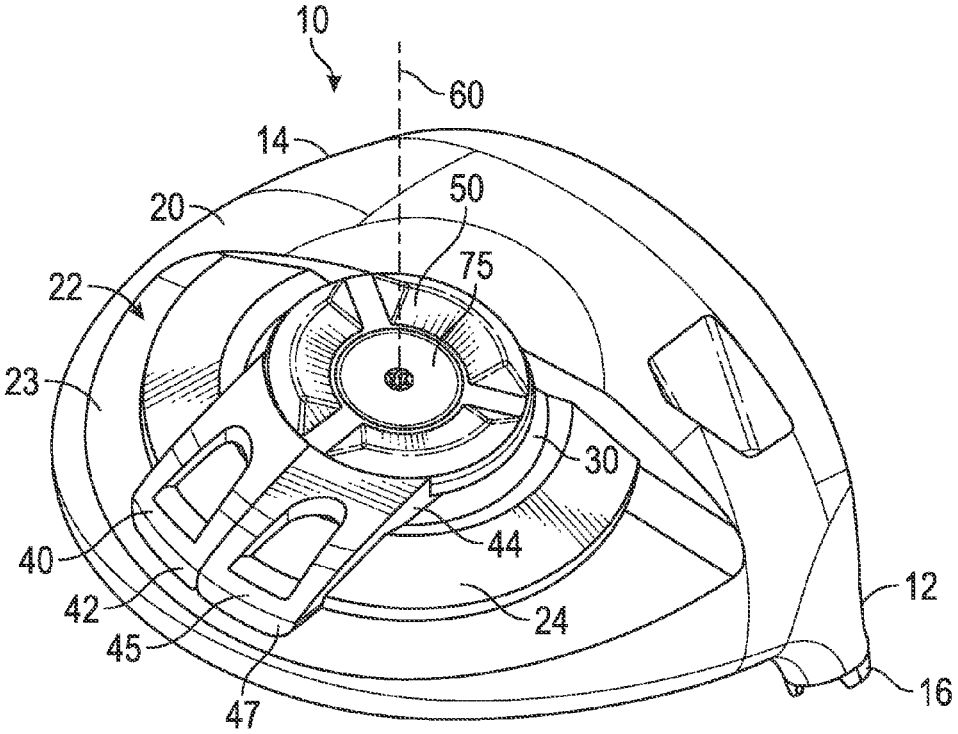
FIG. 1 is a sole perspective view of a golf club head encompassing a first embodiment of the present invention.

The design approaches described herein are based on a construction used in a driver head characterized by a composite crown adhesively bonded to a cast titanium body. This particular construction approach permits the crown configuration to be adapted to the inventive weighting scheme with minimal impact on weight and function. However, the weighting embodiments disclosed herein can be used with other constructions, including all titanium, all composite, and a composite body with metal face cup. They will also work in conjunction with at least one adjustable weight port on the crown of the driver head. Shifting weight as described herein allows for control of center of gravity location, and adjusting the adjustable sole member allows for adjustment of characteristics such as face angle, loft, and/or lie.

A preferred embodiment of the present invention is shown in FIGS. 1-5 and 9. The club head 10 comprises a crown (not shown), a sole 20, a face (not shown), a heel 12, a toe 14, and a hosel 16. The sole 20 comprises a recessed region 22 located at least 0.25 inch away from the face with a raised, partial ring 24 extending perpendicularly away from the base 23 of the recessed region 22. The ring 24 at least partially encircles a recess 30 located in a central region of the sole 20. The recess 30 is sized to receive first end regions 41, 46 of at least two weight bars 40, 45 and an adjustable sole member 50, all of which are rotatable around a central axis 60 intersecting the midpoint of the recess 30. The recess 30 also comprises, at its midpoint, a threaded weight port 70 sized to receive a removable fastener, which preferably is a weight screw 75 having a lip portion 76, a body 77, and a threaded region 78.

Figure 2:
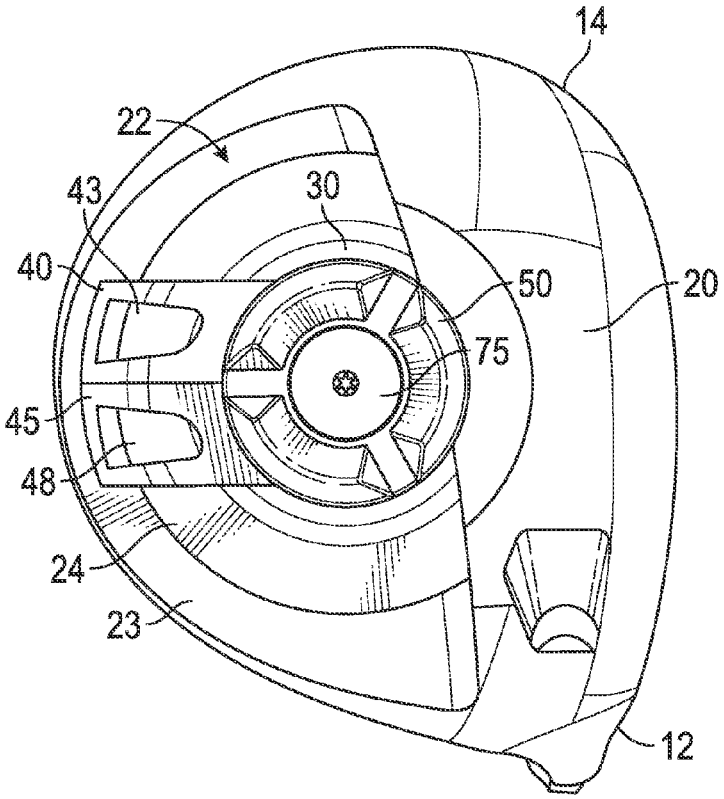
FIG. 2 is a sole plan view of the embodiment shown in FIG. 1.
Figure 3:
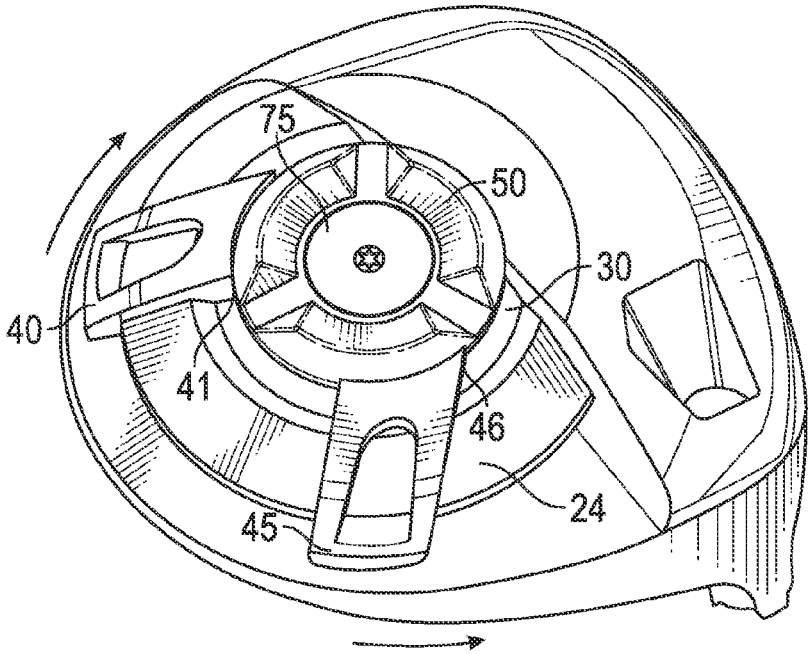
FIG. 3 is a sole perspective view of the embodiment shown in FIG. 1 with a different weight configuration.
Figure 4:
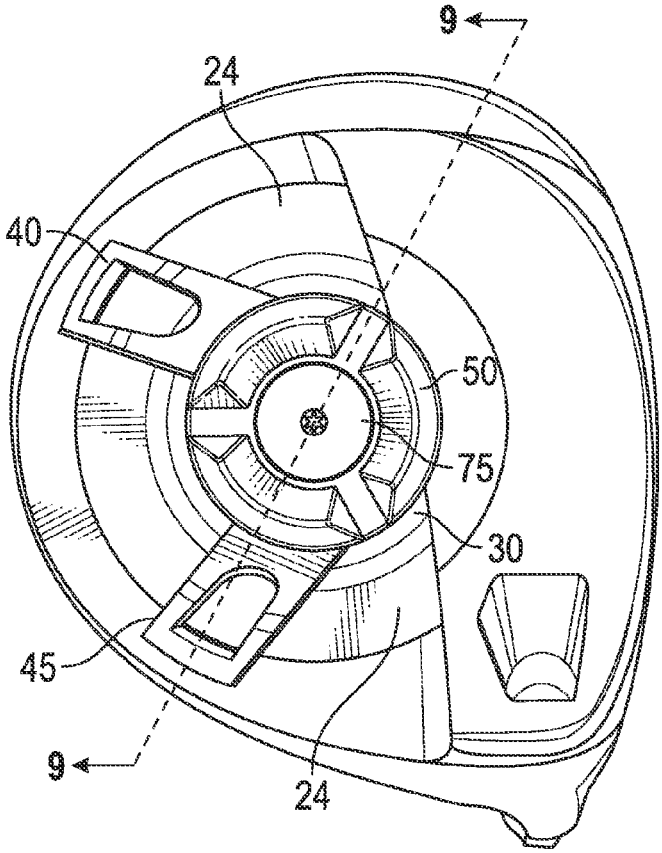
FIG. 4 is a sole plan view of the embodiment shown in FIG. 3.
Figure 5:
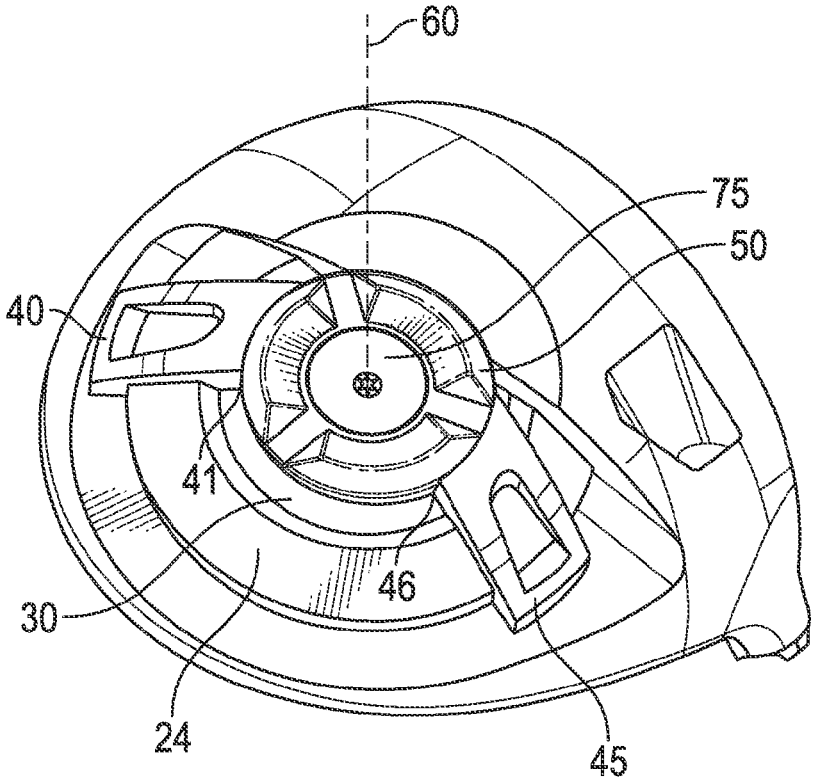
FIG. 5 is a sole perspective view of the embodiment shown in FIG. 1 with another weight configuration.

The preferred embodiment of the present invention allows for adjustment of multiple characteristics of the golf club head 10. As shown in FIGS. 1-5, when the weight screw 75 or other fastener is loosened, and the adjustable sole member 50 is not pressing their first end regions 41, 46, against the sole 20 of the golf club head 10, the weight bars 40, 45 are free to be rotated around the central axis 60 by sliding their second end regions 42, 47 along the recessed region 22 towards the heel 12 and/or toe 14 regions of the golf club head 10. FIGS. 1, 3, and 5 show several configurations of the weight bars 40, 45 on the golf club head 10 of the present invention. Adjusting the weight bars 40, 45 in this manner allows for horizontal adjustment of the golf club's center of gravity location, and also affects face angle. For example, moving the weight bars 40, 45 towards the toe 14 creates a fade effect, moving the weight bars towards the heel 12 creates a draw effect, and centering the weight bars 40, 45 such that they are disposed approximately perpendicular to the face, as shown in FIGS. 1 and 2, creates a neutral effect.

The weight bars 40, 45 preferably have one or more gaps or openings 43, 48 to ensure that more mass is disposed at the second end regions 42, 47 of the weight bars 40, 45, so that moving the weight bars 40, 45 within the recessed region has a greater effect on the location of the golf club head's 10 center of gravity. The second end regions 42, 47 of the weight bars preferably hook over the sides of the ring 24 as shown in FIGS. 1, 3, 5, and 9 to provide greater engagement between the sole 20 and the weight bars 40, 45. In this way, the ring 24 acts as a rail that guides the weight bars 40, 45 as they are moved along the sole 20. The weight bars 40, 45 may be made of any material known to a person of ordinary skill in the art, but preferably are made of multiple materials such that the second end regions 42, 47 are formed from denser material than the first end regions 41, 46. In the preferred embodiment, the second end regions 42, 47 are formed from a tungsten alloy, while the first end regions 41, 46 are formed from an aluminum or stainless steel alloy.

Figure 6:
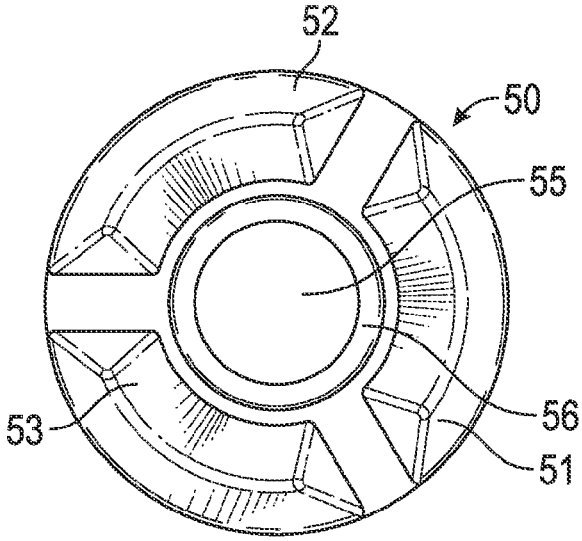
FIG. 6 is bottom plan view of the adjustable sole member shown in FIG. 1.
Figure 7:
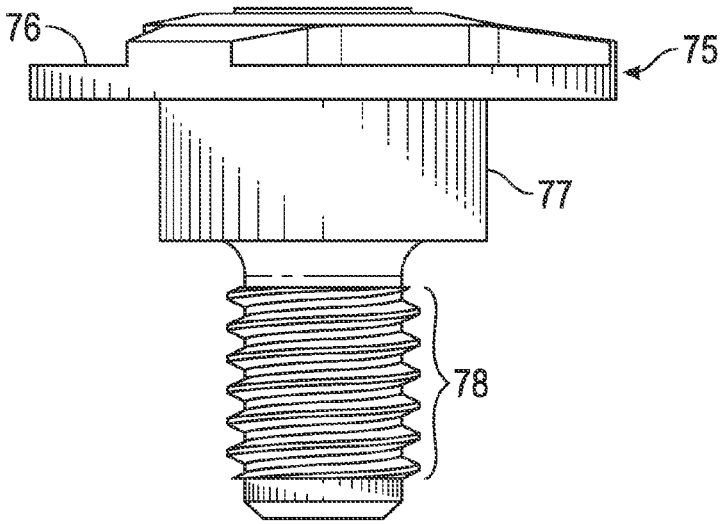
FIG. 7 is a side perspective view of the weight screw shown in FIG. 1.

When the weight screw 75 or other fastener is loosened, the adjustable sole member 50 also can be rotated around the central axis. As shown in FIG. 6, the adjustable sole member 50 has a central bore 55 sized to receive the weight screw 75 and a lower ledge 56 against which a lip portion 76 of the weight screw 75 can rest. The adjustable sole member 50 also has at least three settings, open 51, closed 52, and neutral 53, which change the face angle of the golf club head 10 when it is at address. The adjustable sole member 50 preferably functions in the same manner as the adjustable keel member disclosed in U.S. Pat. No. 7,934,999, the relevant disclosure of which is hereby incorporated by reference herein, wherein each setting (also known as an apex point) has a different height. The adjustable sole member 50 preferably is circular, but in other embodiments may be triangular or have another polygonal shape. The adjustable sole member 50 preferably is composed of a lightweight material such as aluminum alloy, plastic, or composite, or a combination of such materials, but in alternative embodiments may be made of any material known to a person of ordinary skill in the art.

The weight screw 75, which serves to removably but securely affix the adjustable sole member 50 and weight bars 40, 45 to the sole 20 in configurations selected by a user, may have any of the characteristics or features of any of the embodiments disclosed in U.S. patent application Ser. No. 13/410,127, U.S. patent application Ser. No. 13/412,395, U.S. patent application Ser. No. 13,754,373, and/or U.S. Provisional Patent Application No. 61/705,498, the disclosure of each of which is hereby incorporated by reference in its entirety herein. In the preferred embodiment, the golf club head 10 is provided with multiple weight screws 75 having different compositions and/or densities, such that the user can adjust the vertical location of the club head 10 center of gravity by replacing one weight screw 75 with another weight screw 75 having a different density.

Figure 8:
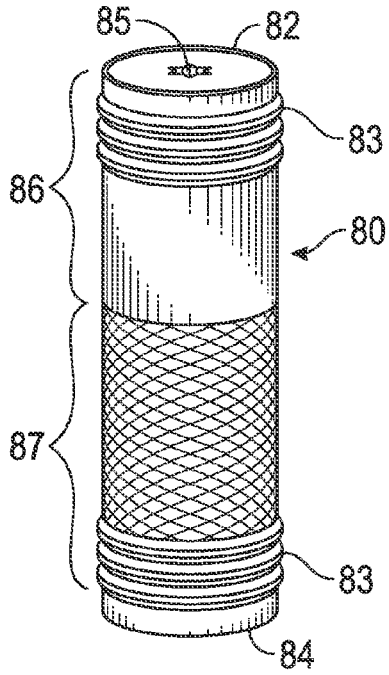
FIG. 8 is a side perspective view of a weight cylinder provided in an alternative embodiment of FIG. 1.
Figure 9:
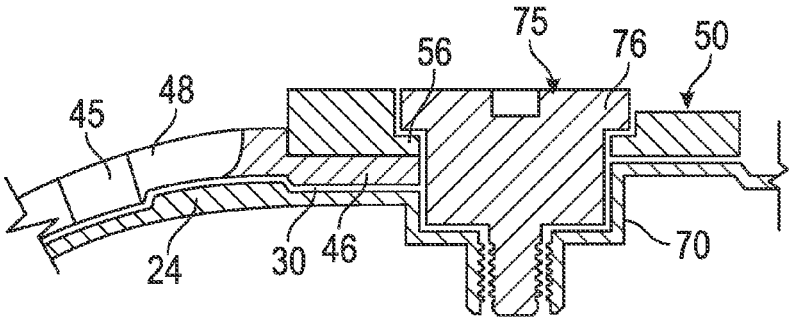
FIG. 9 is a cross-sectional view of the embodiment shown in FIG. 4 along lines 9-9.

In an alternative embodiment, a weight cartridge 80, such as the one shown in FIG. 8, is used instead of a weight screw 75. In this embodiment, the weight port 70 is elongated into a tube sized to receive the weight cartridge 80. The tube may extend from the sole 20 and make contact with the crown or another part of the golf club head 10 (the heel 12 or the toe 14, for instance), or it may be suspended within an interior cavity of the golf club head 10. As shown in FIG. 8, the weight cartridge 80 may be cylindrical, and preferably has a first region 86 formed from a denser material or combination of materials than a second region 87. In this embodiment, when a first end 82 of the weight cartridge 80 is inserted into the weight port 70, such that the second end 84 is disposed proximate the sole 20, the vertical center of gravity of the golf club head 10 differs from when the second end 84 of the weight cartridge 80 is inserted into the weight port 70 such that the first end 82 is disposed proximate the sole 20. In other words, removing, inverting, and then reinserting the weight cartridge 80 into the weight port 70 alters the vertical location of the club head 10 center of gravity.

Each end 82, 84 of the weight cartridge 80 also preferably includes external threads 83 and an opening 85 sized to receive an adjustment tool such as a hex wrench or screwdriver, such that the weight cartridge 80 can be removably secured within the weight port 70. In an alternative embodiment, another method of securing the weight cartridge 80 within the weight port 70 may be used, such as a cap or clip features or any other means known to a person skilled in the art. In each of the alternative embodiments employing a weight cartridge 80, the weight cartridge 80 and the weight port 70 may have any of the features or characteristics of the embodiments disclosed in U.S. Provisional Patent Application No. 61/684,079, the disclosure of which is hereby incorporated in its entirety herein.

The golf club head 10 of the present invention also preferably includes an adjustable hosel assembly, such that loft, lie, and/or face angle can be changed by adjusting the position of a shaft (not shown) with respect to the hosel 16. The golf club head 10 may have any of the adjustable hosel assembly embodiments disclosed in U.S. patent application Ser. Nos. 13/311,319, 13/436,512, 13/368,569, 13/439,664, 13/367,045, 13/326,156, 13/332,846, 13/408,018, 13/544,037, and 13/660,882, the disclosure of each of which is hereby incorporated by reference in its entirety herein, or in U.S. Pat. Nos. 7,083,529, 7,427,239, 7,465,239, 7,578,749, 8,002,644, 8,096,895, 8,235,840, 8,257,193, the disclosure of each of which is hereby incorporated by reference in its entirety herein.

In other embodiments, the club head 10 may have a multi-material composition such as any of those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated by reference in its entirety herein.

Each of the disclosures of U.S. Pat. Nos. 7,934,999, 8,012,034, 8,123,626, 8,221,258, and 8,262,496 to Cackett et al. is hereby incorporated by reference in its entirety herein. The disclosure of U.S. Patent Application Publication Number 2011/0165961 is hereby incorporated by reference in its entirety herein. The disclosure of U.S. patent application Ser. No. 13/410,127 is hereby incorporated by reference in its entirety herein. The disclosure of U.S. Provisional Patent Application No. 61/684,079 is hereby incorporated by reference in its entirety herein. The disclosure of U.S. Provisional Patent Application No. 61/705,498 is hereby incorporated by reference in its entirety herein. The disclosure of U.S. Provisional Patent Application No. 61/727,608 is hereby incorporated by reference in its entirety herein. The disclosure of each of U.S. Pat. No. 7,147,573 to DiMarco and U.S. Pat. No. 7,166,041 to Evans is also hereby incorporated by reference in its entirety.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face, a crown, a sole, and a hosel;

at least one weight bar;

at least one removable weight member; and a central axis, wherein the sole comprises a recessed region and a weight port sized to receive the at least one removable weight member;

wherein the weight port is located at a midpoint of the recessed region, wherein the central axis intersects a midpoint of the weight port, wherein the at least one weight bar comprises a first end and a second end, wherein the at least one weight bar comprises first and second weight bars, wherein the first end has an opening sized to receive the at least one removable weight member, wherein the second end is slidable along the recessed region around the central axis, and wherein the at least one removable weight member removably affixes the first end of the weight bar to the sole such that the at least one weight bar cannot be moved when the removable weight bar is tightly secured within the weight port.

2. The golf club head of claim 1, wherein the at least one removable weight member is a weight screw.

3. The golf club head of claim 1, wherein the at least one removable weight member is a weight cartridge.

4. The golf club head of claim 3, wherein the weight cartridge is composed of more than one material.

5. The golf club head of claim 4, wherein the weight cartridge comprises a first region composed of a first material and a second region composed of a second material, and wherein the first material has a greater density than the second material.

6. The golf club head of claim 3, wherein the weight member has a cylindrical shape.

7. The golf club head of claim 1, further comprising an adjustable sole member, wherein the adjustable sole member has a plurality of settings that affect at least one of golf club face angle, loft, and lie.

8. The golf club head of claim 7, wherein the adjustable sole member comprises a through bore sized to receive the at least one removable weight member, and wherein the adjustable weight member is disposed between the at least one removable weight member and the at least one weight bar.

9. The golf club head of claim 7, wherein the adjustable sole member comprises a first setting having a first height, a second setting having a second height, and a third setting having a third height, wherein the first height is greater than the second height and the second height is greater than the third height.

10. The golf club head of claim 7, wherein the adjustable sole member is circular.

11. The golf club head of claim 1, further comprising an adjustable hosel assembly.

12. A golf club head comprising:

a face, a crown, a sole, and a hosel;

at least one weight bar;

at least one removable weight member; and a central axis, wherein the sole comprises a recessed region and a weight port sized to receive the at least one removable weight member;

wherein the weight port is located at a midpoint of the recessed region, wherein the central axis intersects a midpoint of the weight port, wherein the at least one weight bar comprises a first end and a second end, wherein the at least one weight bar has an approximately rectangular shape, wherein the at least one weight bar has at least one opening disposed proximate the second end, wherein the first end has an opening sized to receive the at least one removable weight member, wherein the second end is slidable along the recessed region around the central axis, and wherein the at least one removable weight member removably affixes the first end of the weight bar to the sole such that the at least one weight bar cannot be moved when the removable weight bar is tightly secured within the weight port.

13. A golf club head comprising:

a face, a crown, a sole, and a hosel;

at least one weight bar;

at least one removable weight member; and a central axis, wherein the sole comprises a recessed region and a weight port sized to receive the at least one removable weight member;

wherein the weight port is located at a midpoint of the recessed region, wherein the central axis intersects a midpoint of the weight port, wherein the at least one weight bar comprises a first end and a second end, wherein the at least one weight bar is composed of more than one material, wherein the first end has an opening sized to receive the at least one removable weight member, wherein the second end is slidable along the recessed region around the central axis, and wherein the at least one removable weight member removably affixes the first end of the weight bar to the sole such that the at least one weight bar cannot be moved when the removable weight bar is tightly secured within the weight port.

14. The golf club head of claim 13, wherein the first end of the weight bar is composed of a first material having a first density, wherein the second end of the weight bar is composed of a second material having a second density, and wherein the second density is greater than the first density.

15. A driver-type golf club head comprising:

a face, a crown, a sole, a hosel, a toe end, and a heel end;

a weight screw;

an adjustable sole member comprising a plurality of settings and a first through bore sized to receive the weight screw;

a first weight bar comprising a first end, a second end, and a second through bore sized to receive the weight screw; and a second weight bar comprising a third end, a fourth end, and a third through bore sized to receive the weight screw, wherein the sole comprises a recessed region, wherein the recessed region comprises a guide rail and a weight port sized to receive the weight screw, wherein the weight port is disposed in a central region of the sole, wherein an axis intersects the weight port and extends upwards towards the crown, wherein the weight screw is sized to extend through the first, second and third through bores to affix the adjustable sole member, the first weight bar, and the second weight bar to the sole within the recessed region, and wherein each of the adjustable sole member, the first weight bar, and the second weight bar are rotatable around the axis.

16. The driver-type golf club head of claim 15, wherein the second through bore extends through the second end, wherein the third through bore extends through the fourth end, and wherein each of the first and third ends makes contact with and is configured to slide along the guide rail.

17. The driver-type golf club head of claim 15, wherein each of the settings of the adjustable sole member affects at least one characteristic selected from the group consisting of face angle, loft angle, and lie angle.

18. The driver-type golf club head of claim 15, wherein each of the face and the hosel is composed of a metal material and wherein each of the crown and the sole is composed of a composite material.

* * * * *